US009885553B2

(12) United States Patent
Langenbeck

(10) Patent No.: US 9,885,553 B2
(45) Date of Patent: Feb. 6, 2018

(54) HOLLOW TUBE PROJECTILES AND LAUNCH SYSTEMS THEREOF

(71) Applicant: Keith Allen Langenbeck, Pleasant View, TN (US)

(72) Inventor: Keith Allen Langenbeck, Pleasant View, TN (US)

( * ) Notice: Subject to any disclaimer, the term of this patent is extended or adjusted under 35 U.S.C. 154(b) by 800 days.

(21) Appl. No.: 14/146,224

(22) Filed: Jan. 2, 2014

(65) Prior Publication Data

US 2016/0216092 A1 Jul. 28, 2016

(51) Int. Cl.
*F42B 10/34* (2006.01)
*F42B 14/06* (2006.01)

(52) U.S. Cl.
CPC ..... *F42B 14/064* (2013.01); *F42B 10/34* (2013.01)

(58) Field of Classification Search
CPC ..... F42B 10/00; F42B 10/32; F42B 10/34; F42B 10/36
USPC ..... 102/501, 503, 509, 520, 439
See application file for complete search history.

(56) References Cited

U.S. PATENT DOCUMENTS 33,746 A * 11/1861 Matteson ..... F42B 10/34 102/503
3,063,376 A * 11/1962 Powell ..... F42B 10/26 102/503
3,800,706 A * 4/1974 Gawlick ..... F42B 10/54 102/529
4,005,319 A * 1/1977 Nilsson ..... H02N 2/185 102/210
4,151,674 A * 5/1979 Klahn ..... A63H 33/18 102/503
4,249,465 A * 2/1981 Ballmann ..... F42B 10/26 102/430
4,296,893 A * 10/1981 Ballmann ..... F42B 10/26 102/501
4,390,148 A * 6/1983 Cudmore ..... B64C 27/00 102/503
4,790,788 A * 12/1988 Hill ..... A63H 27/00 244/153 R
4,936,218 A * 6/1990 Wosenitz ..... F42B 10/34 102/503
5,275,110 A * 1/1994 Flatau ..... F42B 30/02 102/503
5,515,787 A * 5/1996 Middleton ..... F42B 7/10 102/439

(Continued)

*Primary Examiner* — Jonathan C Weber
(74) *Attorney, Agent, or Firm* — Lyman Moulton, Esq.

(57) ABSTRACT

A hollow tube projectile and launch cup system comprises a cylindrical hollow tube with an inwardly chamfered leading end and a plurality of elongate vents spaced evenly around a cylindrical wall. The elongate vents are configured to have a semicircular leading edge and an elliptical trailing edge. The trailing edge is configured to extend at an acute angle from an inner perimeter of the cylindrical wall to an outer perimeter thereof. The disclosed launch cup comprises an outwardly chamfered leading end and a plurality of elongate exterior ribs spaced evenly around an otherwise cylindrical wall. The ribs are configured to extend longitudinally from the leading end toward the trailing end and blend into an anterior skirt on the trailing end. The trailing end is configured in a receptacle aft for explosive propulsion and the leading end is configured in a receptacle fore to receive the hollow tube projectile therein.

12 Claims, 5 Drawing Sheets

(56) References Cited

U.S. PATENT DOCUMENTS

| | | | | |
|---|---|---|---|---|
| 8,881,654 | B2 * | 11/2014 | Seecamp | F42B 12/36<br>102/502 |
| 9,561,402 | B2 * | 2/2017 | Fogarty | A63B 65/00 |

* cited by examiner

HOLLOW TUBE PROJECTILES AND LAUNCH SYSTEMS THEREOF

CROSS-REFERENCE TO RELATED APPLICATION

This application claims the benefit of the priority date of earlier filed U.S. Provisional Patent Application Ser. No. 61/748,149, titled 'Novel Projectiles and Aerodynamic Improvements' filed Jan. 2, 2013 by Keith Langenbeck, and is incorporated herein by reference in its entirety.

BACKGROUND OF THE INVENTION

The field of aerodynamic design for projectiles, aircraft, rockets and the like is extensive. The physical size of small caliber bullets/projectiles presents challenges not encountered in aircraft wing, ballistic missile, artillery shell or aircraft delivered bomb design. For small caliber weapons like handguns, shotguns, rifles and machine guns, performance enhancements have for decades been incremental at best.

Hollow tube projectiles have been studied and tested since before WWI but heretofore have demonstrated inferior ballistic performance at mid-range to longer distances. Conventional hollow tube bullets exhibit inferior ballistic performance due to the air not readily passing though the tube as might be expected and results in drastically reduced ballistic efficiency. At speeds not much below Mach 2, the airflow through the hollow tube chokes itself off, increasing aerodynamic drag and reduced range of the projectile. The dramatic performance limitations caused by the choked flow problem can be understood from the Schlieren photographs found in the 2004 presentation *Performance Potential for a New Machine Gun and Ammunition Concepts* to the US Department of Defense document found at the Defense Technology Information Center web page, www.dtic.mil/ndia/2004solic/flat.ppt. Eliminating the choked flow condition and maintaining the hollow tube bullet's inherent aerodynamic efficiency across the continuum from subsonic through high Mach number velocities is unknown in the art and field of ballistics.

The difference in ballistic efficiency for the projectile diameter used in common handguns and rifles is vast. Handgun projectiles are typically designed for close range and rifles for more distant targets. The different applications affect the overall size of the weapon, bullet shape, bullet diameter, cartridge overall length, magazine capacity and projectile performance. For example, common 30 caliber bullets for handguns have a diameter from 0.309 to 0.312 inches, weigh from 80 to 110 grains and have ballistic coefficients of around 0.100 to 0.150.

Common 30 caliber bullets for rifles have a diameter from 0.303 to 0.311 inches, weigh from 110 to 220 grains and have ballistic coefficients of around 0.250 to 0.450. The lower the ballistic coefficient, the quicker the bullet loses velocity and useful range. Nose profile or shape, ratio of length to diameter, shape of the end of the projectile and other design aspects significantly affect the ballistic coefficient. Typically handgun bullets are larger in diameter than rifle bullets. The 30 caliber cartridges best illustrate the performance variations between handgun and rifle bullets of the same nominal diameter.

The Tokarev handgun cartridge from the Soviet Union, also known as the 7.62×25 mm, commonly has a bullet diameter of 0.309 inches, bullet length of 0.52 inches for a 90 grain weight, case diameter of 0.387 inches, cartridge overall length of 1.34 inches, muzzle velocity of 1400-1700 feet per second from a 4.5 inch barrel, ballistic coefficient of 0.142 and an effective range to 50 meters+/−. The well-known rifle cartridge .308 Winchester, also known as 7.62×51 mm NATO, commonly has a bullet diameter of 0.308 inches, bullet length of 1.15 inches for a 165 grain weight, case diameter of 0.470 inches, cartridge overall length of 2.81 inches, muzzle velocity of 2600-2800 feet per second from a 20 inch barrel, ballistic coefficient of 0.450 and an effective range of 800 meters+/−.

Trying to use lighter weight rifle bullets in a pistol application like the Tokarev results in functional compromises or are simply unworkable. Properly seating a tapered nose, longer bullet can extend the cartridge overall length beyond the physical constraints of the breech or cannibalize case capacity for the propellant needed to move the bullet at desired velocities.

SUMMARY OF THE INVENTION

A hollow tube projectile and launch cup system configured with a leading end to first exit a firearm barrel and a trailing end to follow there through is disclosed herein. The hollow tube projectile and launch cup system comprises a cylindrical hollow tube projectile with an inwardly chamfered leading end and a plurality of elongate vents spaced evenly around a nominally uniform cylindrical wall. The elongate vents are configured to have a semicircular leading edge and a nominally elliptical trailing edge. The trailing edge is configured to extend at an acute angle from an inner perimeter of the uniformly cylindrical wall to an outer perimeter thereof. A disclosed launch cup comprises an outwardly chamfered leading end and a plurality of elongate exterior ribs spaced evenly around an otherwise cylindrical wall. The ribs are configured to extend longitudinally from the leading end toward the trailing end and blend into an anterior skirt on the trailing end. The trailing end is configured in a receptacle aft to facilitate explosive propulsion and the leading end is configured in a receptacle fore to receive the hollow tube projectile therein.

The disclosed hollow tube projectile and launch cup system are combined for firing such that the leading end of the hollow tube projectile is adjacent to the leading end of the launch cup and the trailing end of the hollow tube projectile is adjacent to the trailing end of the launch cup.

The leading edge of each elongate vent is configured to be semicircular and extend at a right angle from an inner perimeter of the uniformly cylindrical wall to the outer perimeter thereof. The trailing edge of each elongate vent is configured to be nominally elliptical. The elongate vents are configured parallel with an elongate axis of the hollow tube projectile for air to egress an interior of the tube through the vents. The elongate vents may also be configured offset from an elongate axis of the hollow tube projectile, an offset axis thereof configured to impart auto-rotation to the hollow tube projectile in flight as air egresses an interior of the tube through the vents. Additionally, adjacent elongate vents may be configured at a staggered length from the leading end of the hollow tube projectile to provide egress paths of various lengths for air escape from an interior of the hollow tube projectile at lower velocities and at higher velocities.

Other aspects and advantages of embodiments of the disclosure will become apparent from the following detailed description, taken in conjunction with the accompanying drawings, illustrated by way of example of the principles of the disclosure.

Figure 1:
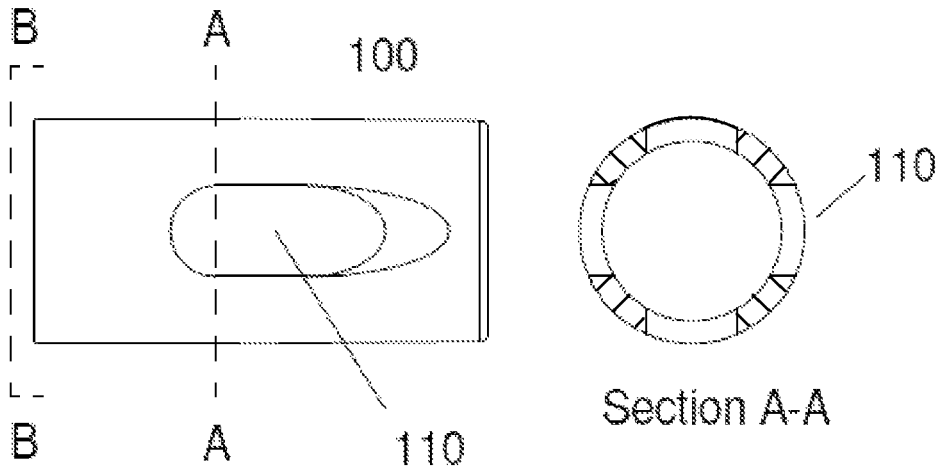
FIG. 1 depicts a top elevational view of a hollow tube projectile and a cross-section A-A through a plurality of slots therein in accordance with an embodiment of the present disclosure.

Throughout the description, similar or same reference numbers may be used to identify similar or same elements in the several embodiments and drawings. Although specific embodiments of the invention have been illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

This application discloses novel and unobvious improvements to projectile performance and launch systems in small caliber weapons but the features and performance benefits could be applied to large caliber projectiles as well. Throughout the present disclosure and continuances and/or divisional disclosures thereof, the terms 'slug,' 'bullet,' and 'projectile' may be used interchangeably to define a mass expelled from a firearm, usually explosively. The term 'nominal' used throughout may define a measurement or a metric near a mean in a normal distribution. Additionally, the terms, 'slot,' 'slit,' and 'vent' may be used interchangeably to define an opening through the cylindrical wall of the projectile for an escape of air short of complete passage through the hollow tube and thus improve the aerodynamics of the slug or bullet. Furthermore, the terms 'launch cup,' or 'sabot' may define a shoe or a receptacle for the bullet or slug which facilitates the explosive propulsion of the bullet or slug but falls away as it leaves the barrel of a firearm.

FIGS. 1 through 9 disclose a novel and unobvious hollow tube bullet or projectile, comprising projectile 100 and launch cup 200. The hollow tube bullet is considered to be a sub-caliber projectile as its outside diameter is less than the bore diameter of the barrel. In this representation the rear portion of the hollow tube bullet resides conformally within the front portion of the launch cup. The exterior surface and features of the launch cup engage the interior surface or bore of the barrel when fired. In this depiction the hollow tube bullet and launch cup when mated together would be loaded into a shotgun shell for firing from a conventional shotgun barrel.

FIG. 1 depicts a top elevational view of a hollow tube projectile and a cross-section A-A through a plurality of slots therein in accordance with an embodiment of the present disclosure. An exterior top view of the projectile 100 as depicted comprises a hollow metal tube with a nominally uniform cylindrical exterior profile and evenly spaced vents or slots 110. In this representation there are four slots which project completely through the wall of the metal tube. Section A-A is a right-angle cross-sectional view through slots 110. The number of slots could be greater than or less than four and is not therefore a limitation in this disclosure. Radial cross-hatching between slots indicates cross-sectional areas.

The hollow tube projectile and launch cup system is configured with a leading end to first exit a firearm barrel and a trailing end to follow there through as disclosed herein. The hollow tube projectile and launch cup system comprises a cylindrical hollow tube projectile with an inwardly chamfered leading end and a plurality of elongate vents spaced evenly around a nominally uniform cylindrical wall. The elongate vents are configured to have a semicircular leading edge and a nominally elliptical trailing edge. The trailing edge is configured to extend at an acute angle from an inner perimeter of the uniformly cylindrical wall to an outer perimeter thereof. An embodiment of the disclosure may include the trailing edge of each elongate vent extending a nominal 3.56 millimeters (0.14 inches), plus or minus ten percent, from the inner perimeter of the uniformly cylindrical wall to the outer perimeter thereof.

Figure 2:
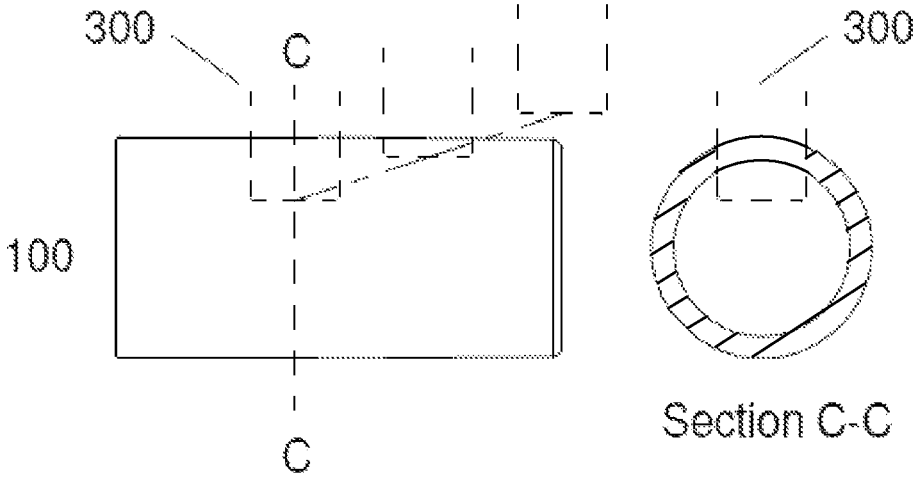
FIG. 2 depicts a side elevational view of the hollow tube slug of FIG. 1 and a cross-section C-C thereof as depicted indicating a machine tool slot cut in accordance with an embodiment of the present disclosure.

FIG. 2 depicts a side elevational view of a hollow tube slug and a cross-section C-C indicating a machine tool slot cut in accordance with an embodiment of the present disclosure. An end mill machining tool 300 and its path are shown in phantom. The tool and path are used to create the various slots 110, in the tube material. Section C-C is a right angle section view through the tube and the machining tool, Item 300, at its point of entry and full penetration depth.

In embodiments of the disclosure, the leading edge of each elongate vent may be configured to be semicircular and extend at a right angle from an inner perimeter of the uniformly cylindrical wall to the outer perimeter thereof. The trailing edge of each elongate vent may be configured to be nominally elliptical. Additionally, adjacent elongate vents may be configured at a staggered length from the leading end of the hollow tube projectile to provide egress paths of various lengths for air escape from an interior of the hollow tube projectile at lower velocities and at higher velocities without traveling the full length of the hollow tube projectile.

Figure 3:
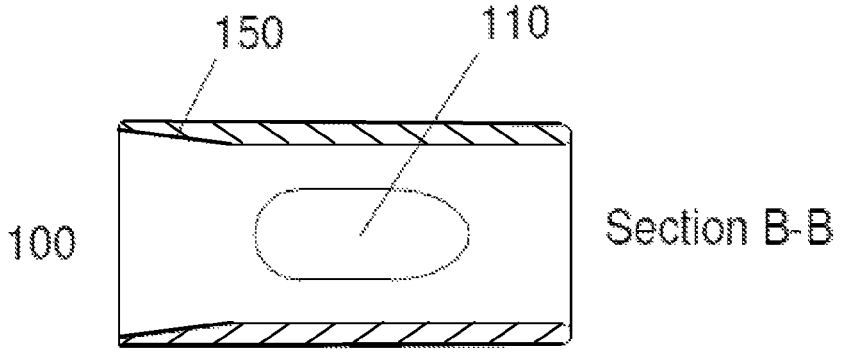
FIG. 3 depicts a longitudinal cross sectional view B-B from FIG. 1 taken lengthwise through the hollow tube projectile of FIG. 1 in accordance with an embodiment of the present disclosure.

FIG. 3 depicts a longitudinal cross sectional view B-B from FIG. 1 taken lengthwise through the hollow tube projectile of FIG. 1 in accordance with an embodiment of the present disclosure. Section B-B, taken down the major centerline axis reveals the interior shape of slots 110. Also seen is the interior throat, Item 150, which has been machine tapered into the material thickness from leading back toward to the slots 110.

An embodiment may include a vent opening width configured to be in a range from a nominal 6.35 millimeters (0.250 inches) to a nominal 9.53 millimeters (0.38 inches) plus or minus a ten percent manufacturing tolerance. Also, the trailing end of the hollow tube projectile may be configured to be rounded or tapered and any other finishing geometry suitable to aerodynamic advantage to avoid eddy currents and voids which hinder the movement of the projectile through the air and/or through fluids. The chamfered front end may be configured to extend a nominal 8.13 millimeters (0.32 inches), plus or minus ten percent, from a butt end portion at an acute angle to an inner perimeter of the uniformly cylindrical wall. Furthermore, a taper on an anterior portion of the hollow tube projectile may be configured for ease of insertion into a launch cup and ease of separation therefrom after leaving a barrel of a firearm.

Figure 4:
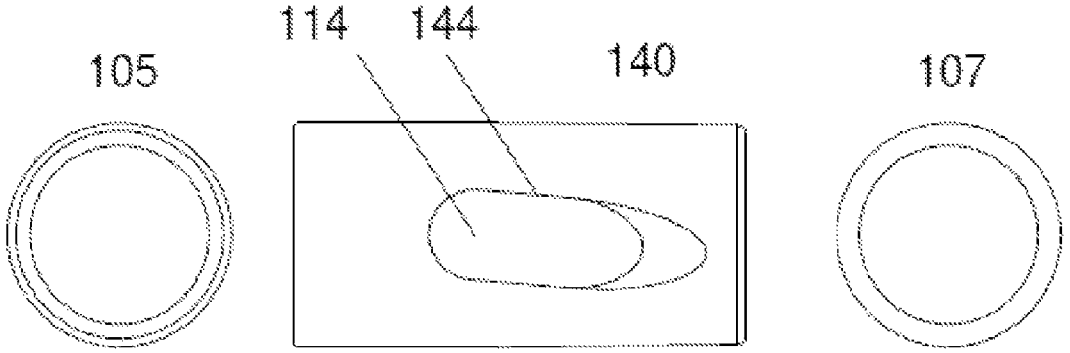
FIG. 4 depicts a top elevational view of a hollow tube projectile with an offset slot in accordance with an embodiment of the present disclosure.

FIG. 4 depicts a top elevational view of a hollow tube projectile with an offset slot in accordance with an embodiment of the present disclosure. A front elevational view 105 depicts the butt end, the taper and the throat of the hollow tube projectile 140. A back elevational view 107 depicts the finished trailing end of the hollow tube projectile 140. One difference between projectile 100, and projectile 140, are the offset slots 114. The offset slots are machined in the same manner as depicted in FIG. 2 but with the tool path being rotated clockwise with respect to the longitudinal axis a nominal 5 degrees.

Slots 114 generate a shallow fletching-like angle relative to the major centerline axis of the projectile, Item 140. Slots, Item 114, cause the exiting air to bear against the material thickness wall, Item 144, imparting a torque or rotating force as the air flows through the center of the tube and exits through the slots, Item 114. This airflow path will cause auto-rotation of the projectile, Item 140, without the need for conventional rifling. Item 105 the front end view of hollow tube projectile Item 100 or Item 140. Item 107 is the rear end view of hollow tube projectile Item 100 or Item 140.

In other words, the elongate vents may be configured parallel with an elongate axis of the hollow tube projectile or they may be configured offset from an elongate axis of the hollow tube projectile. An offset axis thereof imparts auto-rotation to the hollow tube projectile in flight and thus may stabilize the projectile through gyroscopic forces thereon. An outer diameter of the hollow tube projectile nominally measures 15.88 millimeters (0.625 inches) plus or minus a ten percent manufacturing tolerance. Also, the disclosed hollow tube projectile may comprise a nominally uniform diameter from the leading end to the trailing end thereof.

Figure 5:
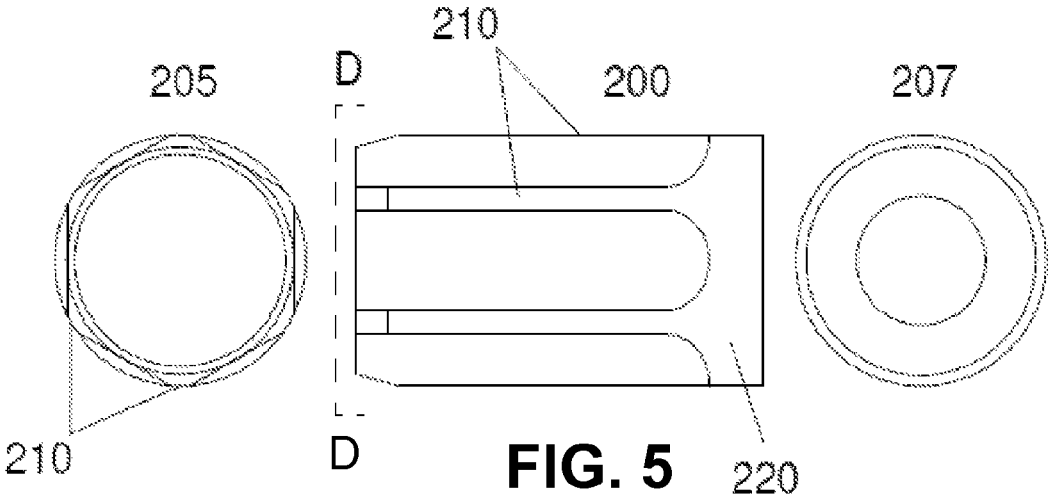
FIG. 5 depicts a side elevational view of a hexagonal launch cup with a chamfered front end and a circular back end in accordance with an embodiment of the present disclosure.

FIG. 5 depicts a side elevational view of a hexagonal sabot with a chamfered front end and a circular back end in accordance with an embodiment of the present disclosure. The launch cup or also known as a sabot, Item 200, may be comprised of machined or injection molded plastic material or a composite thereof. Item 210 is depicted with six exterior ribs that would engage bore of the barrel when fired. The exterior surface of ribs 210 commence near the leading edge of Item 200 and continue back and blend into the anterior skirt, Item 220. The exterior surfaces of Item 210 and Item 220 both have the same diameter for engaging the bore of the firearm barrel.

The disclosed launch cup comprises an outwardly chamfered leading end and a plurality of elongate exterior ribs spaced evenly around an otherwise cylindrical wall. The ribs are configured to extend longitudinally from the leading end toward the trailing end and blend into an anterior skirt on the trailing end. The trailing end is configured in a receptacle aft and the leading end is configured in a receptacle fore to receive the hollow tube projectile therein.

A front elevational view 205 of the launch cup 200 depict exterior ribs 210 configured to form a plurality of arc segments comprising a radius equivalent to a radius of the anterior skirt to engage a bore of a firearm barrel. A rear elevational view 207 of the launch cup 200 shows an inward taper from a peripheral edge thereof to inter alia facilitate injection molding draw. A taper on the injection molded receptacle fore also facilitates the insertion and separation of the hollow tube projectile from the launch cup as further explained below.

Figure 6:
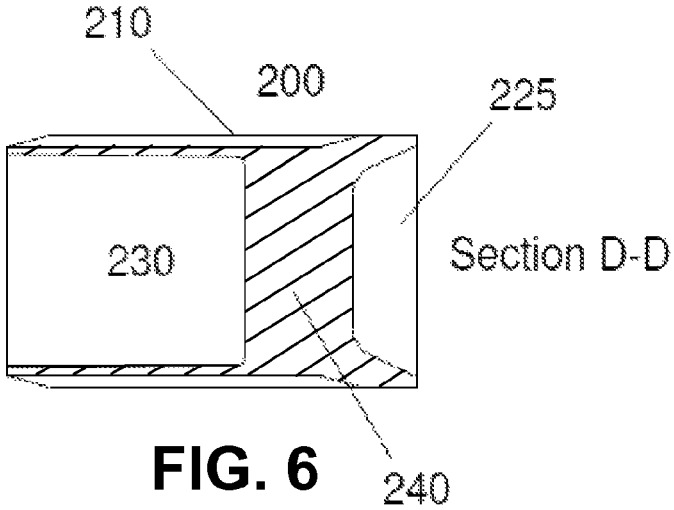
FIG. 6 depicts a longitudinal cross sectional view D-D from FIG. 5 taken lengthwise through the launch cup of FIG. 5 in accordance with an embodiment of the present disclosure.

FIG. 6 depicts a longitudinal cross sectional view D-D from FIG. 5 taken lengthwise through the launch cup of FIG. 5 in accordance with an embodiment of the present disclosure. The longitudinal view, Section D-D, down the major centerline axis of Item 200 reveals the interior shape of launch cup, Item 200. Item 230 is the anterior receptacle for receiving the posterior exterior portion of Item 100 in conformal relationship when fitted together. Item 240 is the solid interior floor underneath Item 230. Item 225 is the posterior receptacle aft of Item 240. The projectile launch cup further comprises a solid interior floor 240 between the receptacle fore of the leading end and the receptacle aft of the trailing end.

Figure 7:
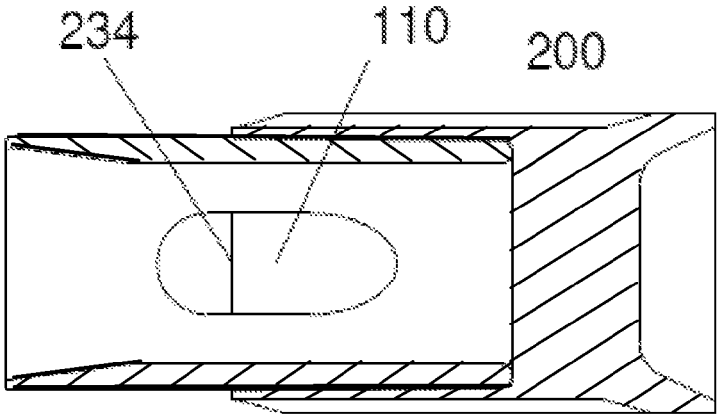
FIG. 7 is a combined longitudinal cross sectional view of FIG. 3 and FIG. 6 of the hollow tube projectile of FIG. 3 in the launch cup of FIG. 6 in accordance with an embodiment of the present disclosure.

FIG. 7 is a combined longitudinal cross sectional view of FIG. 3 and FIG. 6 of the hollow tube projectile of FIG. 3 in the launch cup of FIG. 6 in accordance with an embodiment of the present disclosure. The combined sectional view of Item 100 from FIG. 3 in conformal relationship with the sectional view of Item 200 from FIG. 6. Item 234 is a portion of the interior leading edge of Item 230 as seen through the interior view of slot, Item 110.

Therefore, the leading end of the hollow tube projectile is adjacent to the leading end of the launch cup and the trailing end of the hollow tube projectile is adjacent to the trailing end of the launch cup in an embodiment of the disclosure. Also, a portion of the leading end of the launch cup may therefore be visible through an elongate vent of the hollow tube projectile as depicted.

Figure 8:
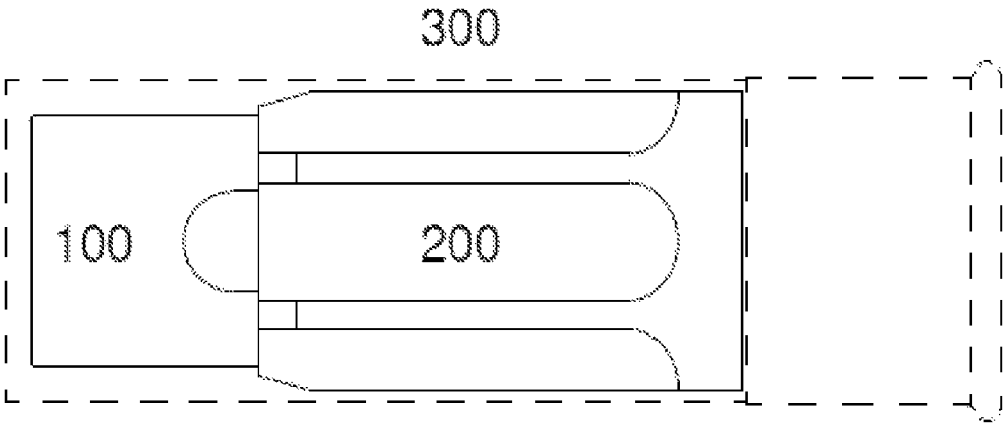
FIG. 8 depicts a side elevational view of the hollow tube projectile of FIG. 1 inside the launch cup of FIG. 5 loaded within a shotgun shell in broken lines in accordance with an embodiment of the present disclosure.

FIG. 8 depicts a side elevational view of the hollow tube projectile of FIG. 1 inside the launch cup of FIG. 5 loaded within a shotgun shell in broken lines in accordance with an embodiment of the present disclosure. The depicted view of the combined projectile, Item 100, fitted together with launch cup, Item 200, and loaded within a conventional shotgun shell, Item 300, shown in phantom.

Figure 9:
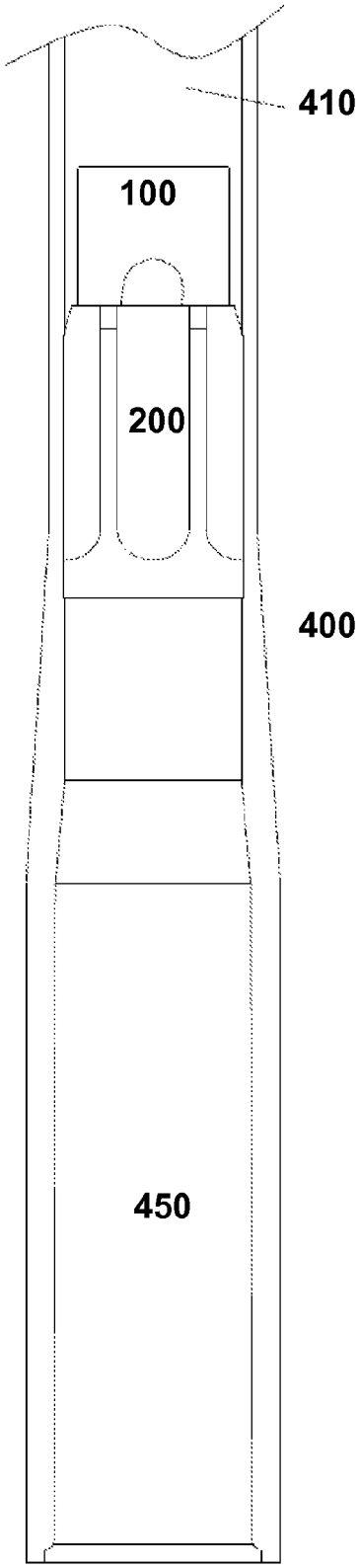
FIG. 9 depicts a portion of a shotgun barrel with a loaded shotgun shell comprising the hollow tube projectile and the launch cup in accordance with an embodiment of the present disclosure.

FIG. 9 depicts a portion of a shotgun barrel with a loaded shotgun shell comprising the hollow tube projectile and the launch cup in accordance with an embodiment of the present disclosure. The depicted portion of a shotgun barrel, Item 400, includes the chamber portion, Item 450, into which a loaded shogun shell, Item 300, would reside for firing. Also depicted are Item 100 and Item 200 in conformal relationship immediately after firing from the shotgun shell and within the bore of the barrel, Item 410. It can be readily seen that the diameter of projectile, Item 100, is less than the bore diameter, Item 410 and the exterior dimension of Item 200 is essentially the same and in intimate contact with Item 410.

Upon exiting the barrel, Item 400, the projectile, Item 100, will separate from the launch cup, Item 200, as the air passing into Item 105, and through the back of the projectile, Item 107, and through slots, Item 110, will retard the velocity of Item 200 to a far greater degree than Item 100.

Among the weapons that could use the projectiles described herein are common shotguns. Although not required or specified, the nominal outside diameter for the projectiles depicted is approximately 0.625 inches. These projectile variants are designed to fit within every day shot gun shells and used in smooth or rifled barrel shotguns. The hollow tube projectiles described herein could be made from readily available metal tube on Computer Numerically Controlled machining centers or various other means common to industry.

Although the components herein are shown and described in a particular order, the order thereof may be altered so that certain advantages or characteristics may be optimized. In another embodiment, instructions or sub-operations of distinct steps may be implemented in an intermittent and/or alternating manner.

Notwithstanding specific embodiments of the invention have been described and illustrated, the invention is not to be limited to the specific forms or arrangements of parts so described and illustrated. The scope of the invention is to be defined by the claims and their equivalents.

What is claimed is:

1. A hollow tube projectile configured with a leading end to first exit a firearm barrel and a trailing end to follow there through, the hollow tube projectile comprising a nominally cylindrical wall with an inwardly chamfered leading end and a plurality of elongate vents spaced evenly around the nominally cylindrical wall, the elongate vents configured to have a leading edge and a trailing edge, the trailing edge configured to extend at an acute angle from an inner perimeter of the nominally cylindrical wall to an outer perimeter thereof, wherein the leading edge of each elongate vent is configured to be semicircular and extend at a right angle from an inner perimeter of the nominally cylindrical wall to the outer perimeter thereof.

2. The hollow tube projectile of claim 1, wherein the trailing edge of each elongate vent is configured to be nominally elliptical.

3. The hollow tube projectile of claim 1, wherein the trailing edge of each elongate vent extends a nominal 3.56 millimeters (0.14 inches), plus or minus ten percent, from the inner perimeter of the nominally cylindrical wall to the outer perimeter thereof.

4. The hollow tube projectile of claim 1, wherein the trailing end of the hollow tube projectile is configured to be one of rounded and tapered.

5. The hollow tube projectile of claim 1, wherein the chamfered front end is configured to extend a nominal 8.13 millimeters (0.32 inches), plus or minus ten percent, from a butt end portion at an acute angle to an inner perimeter of the nominally cylindrical wall.

6. The hollow tube projectile of claim 1, wherein the elongate vents are configured parallel with an elongate axis of the hollow tube projectile for air to egress an interior of the tube through the vents.

7. The hollow tube projectile of claim 1, wherein the elongate vents are configured to be offset from an elongate axis of the hollow tube projectile, an offset axis thereof configured to impart auto-rotation to the hollow tube projectile in flight as air egresses an interior of the tube through the vents.

8. The hollow tube projectile of claim 1, wherein an outer diameter of the hollow tube projectile is nominally 15.88 millimeters (0.625 inches) plus or minus a ten percent manufacturing tolerance.

9. The hollow tube projectile of claim 1, wherein adjacent elongate vents are configured at a staggered length from the leading end of the hollow tube projectile to provide egress paths of various lengths for air escape from an interior of the hollow tube projectile at lower velocities and at higher velocities.

10. The hollow tube projectile of claim 1, further comprising a nominally uniform diameter from the leading end to the trailing end thereof.

11. The hollow tube projectile of claim 1, further comprising a vent opening width configured to be in a range from a nominal 6.35 millimeters (0.250 inches) to a nominal 9.53 millimeters (0.38 inches) plus or minus a ten percent manufacturing tolerance.

12. The hollow tube projectile of claim 1, further comprising a taper on an anterior portion of the hollow tube projectile, the tapered anterior portion configured for ease of insertion into a launch cup and ease of separation therefrom after leaving a barrel of a firearm.

* * * * *